United States Patent [19]

Berg et al.

[11] 4,362,682

[45] Dec. 7, 1982

[54] CHIP-FREE STAPLE FIBER PROCESS

[75] Inventors: Gerald A. Berg, Lake Jackson, Tex.; Hermann Buchert, Williamsburg, Va.; Steve R. Duffy, Clute, Tex.; Richard E. Harder, Anderson, S.C.; E. R. Higgs, Clute, Tex.; Louis D. Hoblit; James R. Ryffel, both of Lake Jackson, Tex.; Walter P. Smith, Anderson, S.C.; Edwin L. Stenzel, Morristown, N.J.

[73] Assignee: Badische Corporation, Williamsburg, Va.

[21] Appl. No.: 179,583

[22] Filed: Aug. 21, 1980

[51] Int. Cl.[3] ..... D01D 9/10

[52] U.S. Cl. ..... 264/143; 264/210.8; 264/233; 264/237; 425/72 S

[58] Field of Search ..... 264/169, 233, 168, 210.8, 264/143, 237; 425/72 S

[56] References Cited

U.S. PATENT DOCUMENTS

| | | | |
|---|---|---|---|
| 3,046,083 | 7/1962 | Bates et al. | 264/168 |
| 3,213,171 | 10/1965 | Kilian | 264/168 |
| 3,271,943 | 9/1966 | Williams | 264/168 |
| 3,705,227 | 12/1972 | Fintel et al. | 425/72 S |
| 4,045,534 | 8/1977 | Fisher et al. | 264/176 F |
| 4,227,906 | 10/1980 | Rieser | 264/176 F |

FOREIGN PATENT DOCUMENTS

| | | | |
|---|---|---|---|
| 1435476 | 3/1969 | Fed. Rep. of Germany | 264/237 |
| 2360854 | 10/1975 | Fed. Rep. of Germany | 264/210.8 |
| 32-5815 | 8/1957 | Japan | 264/169 |
| 40-25172 | 11/1965 | Japan | 264/169 |
| 40-27373 | 12/1965 | Japan | 264/233 |
| 44-21169 | 9/1969 | Japan | 264/176 F |
| 46-37773 | 11/1971 | Japan | 425/72 S |

OTHER PUBLICATIONS

Reyon & Synthetica Zellwolle, vol. 29, (1951), pp. 9-22.

*Primary Examiner*—Jay H. Woo
*Attorney, Agent, or Firm*—George F. Helfrich

[57] ABSTRACT

An equilibrium melt from a standard hydrolytic or anionic polymerization of caprolactam is spun at a temperature between about 230° and 270° C. through a spinnerette, preferably one having a multiplicity of holes spaced from each other in an asymmetric arrangement, the spinning take-away speed being less than about 250 meters/minute. The molten strands of polycaprolactam are quenched in two phases: (1) gas at a temperature of less than 20° C. is directed from a first entrance in a crosscurrent flow upon the face of the spinnerette and upon the molten polycaprolactam strands immediately adjacent thereto, and is exhausted adjacent to the back of the spinnerette; and (2) gas at a temperature of less than 20° C. is directed in a countercurrent flow from a second entrance downstream from the first entrance with respect to the direction of movement of the polycaprolactam strands; whereby the surface temperature of the polycaprolactam strands is reduced to 30°-70° C. A drawing and crimping lubricant and antistatic agent is then applied to the surface of the polycaprolactam strands, which are then drawn at a total draw ratio between 3 and 5. The polycaprolactam strands are then crimped and cut into staple lengths, which are subsequently washed in multiple stages, dried, and packaged for subsequent use or sale.

7 Claims, 1 Drawing Figure

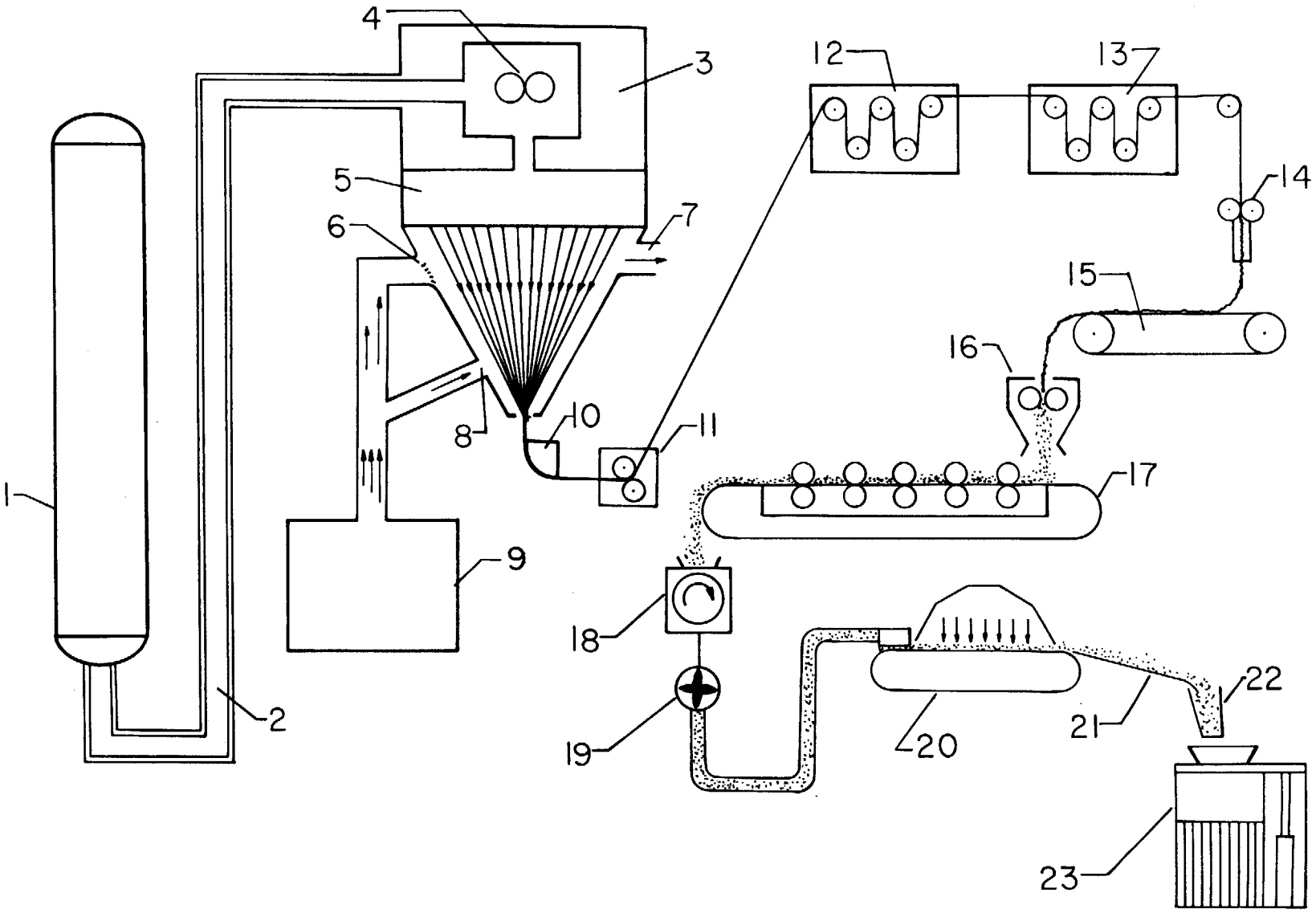
1
2
3
4
5
6
7
8
9
10
11
12
13
14
15
16
17
18
19
20
21
22
23

CHIP-FREE STAPLE FIBER PROCESS

BACKGROUND OF THE INVENTION

1. Field of the Invention

The present invention relates generally to the melt spinning of polycaprolactam. In particular, it relates to a continuous process for producing a staple fiber product by the direct spinning of polycaprolactam from an equilibrium melt.

2. Prior Art Statement

In the commercial evolution of processes for the melt spinning of polycaprolactam, it has been recognized for some time that the direct utilization of an equilibrium melt from a standard polymerization of caprolactam could afford economic advantages over commonly-employed processes utilizing polymer chips from which monomeric and oligomeric materials have been removed. Indeed, a number of "direct spinning" processes have been proposed over the years, in an effort to attain the economy of operation which is so desirable. However, all of these expedients have been found wanting, in that none actually affords the desired economy of operation in combination with the process efficiency and efficacy necessary to produce the quality product which is required in the marketplace. The closest prior art is considered to be:

1. U.S. Pat. No. 2,733,122 (Herele, et al). This patent discloses a process for producing staple fibers from epsilon-aminocaproic acid condensation products which contain water-soluble monomeric and oligomeric materials. The process is the sequential combination of the following procedural steps: (a) extruding filaments of the aforementioned epsilon-aminocaproic acid condensation products and combining these filaments into a tow of at least 40,000 denier; (b) placing a tension upon the tow to stretch the filaments to a multiple of their length; (c) washing the stretched tow with a hot aqueous washing agent; (d) drying the washed tow to a degree of moisture of less than 6 percent; the washing and drying of the tow being accomplished while tension is being maintained on the tow; (e) crimping the dried filaments of the tow in a continuous mechanical crimper while maintaining the moisture content of less than 6 percent; followed by cutting the crimped tow into staple fibers and opening the staple fibers by means of an air jet. Nowhere comprehended in this reference are the following essential limiations found in the present process: (a) the employment of a two-phase quenching technique to lower the temperature of the extruded filaments to a value between about 30° and 70° C. before drawing thereof is effected; (b) drawing, crimping, and cutting the unextracted filamentary polymeric material, to the surface of which a drawing and crimping lubricant and antistatic agent has been applied; and (c) the employment of a particularly-defined asymmetric spinnerette as a preferred embodiment.
2. U.S. Pat. No. 2,703,433 (Holzmann). This patent discloses a spinnerette for the production of filaments used in making staple fibers. Provided is a plate having a plurality of spinning orifices arranged in groups spaced from each other to provide concentric annular opening—free channels in the plate and radial opening—free channels in the plate extending toward the center. The spacing between the groups of spinning openings providing the radial and annular opening—free channels is substantially greater than the spacing between the individual spinning openings in each group, which are arranged in a plurality of rows disposed at different distances from the center of the plate. Although an asymmetric arrangement of spinning orifices is presented, there is no disclosure or suggestion of the configuration considered especially preferred in the practice of the present invention, viz., the space between adjacent spinning orifices increases from each side of the spinnerette to the center thereof and from the front to the back thereof.
3. U.S. Pat. No. 3,047,541 (K. Ryffel, et al). This patent discloses a process for the continuous production of polyamide fibers by the direct spinning of a polycaprolactam melt containing monomeric and oligomeric material. The extrudate is immediately stretched to produce fibers having a very low elongation at break. Stretching is facilitated by treating the surface of the extrudate with an emulsifying oil. Nowhere disclosed or suggested are the following essential limitations found in the present process: (a) the employment of a two-phase quenching technique to lower the temperature of the extruded filaments to a value between about 30° and 70° C. before drawing thereof is effected; (b) crimping and cutting the unextracted filamentary polymeric material after drawing thereof, and after a drawing and crimping lubricant and antistatic agent (preferably water) has been applied; and (c) the employment of a particularly-defined asymmetric spinnerette as a preferred embodiment.

In fact, the prior art, as particularized by the references set forth above, actually presents a background against which the present invention stands out as a valuable improvement. This will become apparent to those of skill in the art upon a study of the present invention as specified hereinafter.

SUMMARY OF THE PRESENT INVENTION

In order to provide an economical, efficient, and efficacious process for the production of a staple fiber product, the following combination of procedural steps is provided:

A. Spinning an equilibrium melt from a standard hydrolytic or anionic polymerization of caprolactam, the equilibrium melt containing methanol-extractable material including monomeric and oligomeric substances, the equilibrium melt being spun at a temperature of between about 230° and 270° C. through a spinnerette, the spinning take-away speed being less than about 250 meters/minute;

B. Quenching the molten polycaprolactam in two phases:

(1) Directing gas at a temperature of less than 20° C. at a flow rate of between 200 and 500 cubic feet/minute for a polycaprolactam throughput of between about 0.25 to 1 gram/minute/spinnerette hole, to impinge upon the face of the spinnerette and molten polycaprolactam strands immediately adjacent thereto from a first entrance which is proximate to a section referred to as the front of the spinnerette, and to be exhausted proximate to a section referred to as the back of the spinnerette; and (2) Directing gas at a temperature of less than about 20° C. in an essentially countercurrent flow from a second entrance downstream from the first entrance with respect to the direction of movement of the filamentary polycaprolactam, at a rate which results in reducing the surface temperature of the polycaprolactam to a value between 30° and 70° C. before drawing thereof as hereinafter defined;

C. Applying a drawing and crimping lubricant and antistatic agent to the surface of the filamentary polycaprolactam;

D. Drawing the filamentary polycaprolactam by conventional means at a total draw ratio between about 3 and 5;

E. Crimping the drawn filamentary polycaprolactam by essentially conventional means;

F. Cutting the crimped filamentary polycaprolactam into staple lengths by conventional means;

G. Subjecting the filamentary polycaprolactam staple to a multiple stage washing procedure for removal of extractables;

H. Drying the washed filamentary polycaprolactam staple by conventional means; and I. Packaging the dried filamentary polycaprolactam staple for subsequent use or sale.

Especially advantageous results are obtained if the drawing and crimping lubricant and antistatic agent is a compound or mixture which does not adversely affect conventional, wet monomer recovery systems, e.g., water, which is applied in an amount of about 25–50 pounds thereof per every 100 pounds of dry filamentary polycaprolactam.

Highly beneficial results are obtained when the crimping is effected in an otherwise standard stuffer box, the dimensions of which have been shortened and widened to avoid excessive crimping and reduction of the physical properties of the fiber.

In the practice of the present invention further economy is achieved if the exhausted quenching gas from step B above which comprises unreacted monomeric material, is treated by conventional recovery techniques, such as a wet scrubber or electrostatic precipitator, to recover the monomeric material. Even greater economy is achieved if the spent wash medium from step G above is treated by conventional means for recovery of the monomer.

In the practice of the present invention especially good results are achieved if the draw ratio set forth in step D above is between 3.2 and 4.4.

The best results are achieved if the spinnerette employed has a multiplicity of holes spaced from each other in an asymmetric arrangement wherein the space between adjacent holes increases from each side of the spinnerette to the center thereof and from the front to the back thereof, the front being defined as that section proximate to the first entrance of quench gas, and the back being defined as that section proximate to the exhaust of quench gas.

BRIEF DESCRIPTION OF THE DRAWING

For a more complete understanding of the present invention, including its benefits and advantages over the prior art, reference should be made to the Description of the Preferred Embodiments, which is set forth in detail below. This detailed description should be read together with the accompanying drawing, the single FIGURE of which is a schematic representation of the present invention.

DESCRIPTION OF THE PREFERRED EMBODIMENTS

Referring now to the drawing, a process is shown for directly converting caprolactam through equilibrium melt polymer to finished nylon 6 staple in one continuous chemical and fiber process, according to an especially preferred embodiment of the present invention.

A continuous stream of an equilibrium melt from a standard hydrolytic polymerization of epsilon-caprolactam is withdrawn from reactor (1). The equilibrium melt contains from about 8 to 15 percent methanol-extractable material, which includes monomeric and oligomeric substances. (Equilibrium melt from a standard anionic polymerization of epsilon-caprolactam may be employed, if desired, in place of the polymer used here, with the same beneficial results.) The polymer stream is caused to flow through jacketed polymer line (2) at a rate of about 1200 g/min by means of a booster pump (not shown) to a jacketed spin head (3). Before entering spin head (3), the polymer stream passes through a nominal 15 micron continuous filter (not shown). Metering pump (4) causes the polymer stream to pass into spin pack (5), whence the polymer stream is spun through a spinnerette having 2574 Y-shaped holes spaced from each other in an asymmetric arrangement, wherein the space between adjacent holes increases from each side of the spinnerette to the center thereof, and from the front to the back thereof, the front and back of the spinnerette being defined hereinafter. Polymer temperature in spin pack (5) is maintained at a temperature between about 230° and 270° C., preferably between 250° and 260° C. Although the asymmetric spinnerette described above is most desirable in carrying out the present invention, other spinnerettes commonly employed in the art may be utilized. The particular temperature chosen for the polymer in spin pack (5) depends upon the actual molecular weight of the polymer, as understood by those of skill in the art.

The molten strands of extruded polymer are quenched in two phases. In the first phase, gas (preferably air) at a temperature of less than 20° C. (preferably about 10° C.) is directed as from entrance (6) at a flow rate of between about 200 to 500 cubic feet/minute (preferably about (250-350) for a polycaprolactam throughput of between about 0.25 to 1 gram/minute/-spinnerette hole, to impinge upon the face of the spinnerette and molten polycaprolactam strands immediately adjacent thereto. That is to say, the gas is directed onto the spinnerette face and the first 2–3 inches of the spun filaments. The section of the spinnerette which is proximate to this first impinging stream of quench gas is called the front of the spinnerette. The quench gas is exhausted as from exit (7) proximate to the back of the spinnerette. This quench gas, which contains unreacted monomeric material, is preferably treated by conventional recovery techniques (not shown), such as a wet scrubber or an electrostatic precipitator, to recover the monomeric material present therein. In the second quenching phase, gas at a temperature of less than 20° C. (preferably about 10° C.) is directed as from entrance (8) in an essentially countercurrent flow at a rate which results in reducing the surface temperature of the filamentary polycaprolactam to a value between about 30° and 70° C. (optimally between 40° and 45° C.), before the subsequent drawing thereof. Entrance (8) is, as shown, downstream from entrance (6), with respect to the direction of movement of the filamentary polycaprolactam. The surface temperature of the filamentary polycaprolactam is conveniently measured by means of any of a number of commercially—available dynamic fiber temperature measuring instruments (not shown). In order to ensure optimum crystallization and fiber properties, it is essential that the surface temperature of the filamentary polycaprolactam be between about 30° and 70° C. at this point. Quench gas is supplied to entrances (6) and (8) by a source (9), such as an air conditioning system.

After quenching has been accomplished, the filamentary polycaprolactam strands are taken away at a speed of less than about 250 meters per minute (preferably 100–150 meters per minute), and treated as at (10) with a drawing and crimping lubricant and antistatic agent, which is applied to the surface of the strands by conventional means. The drawing and crimping lubricant and antistatic agent is desirably a compound or mixture which will not adversely affect conventional, wet monomer recovery systems. The drawing and crimping lubricant and antistatic agent is most advantageously water, which is applied, as from a bath, in an amount of about 25–50 (preferably 40) pounds thereof per 100 pounds of dry filamentary polycaprolactam tow. Nip roll (11), which provides for the uniform takeaway of the tow, is advantageously operated at a surface speed of about 100–110 meters/minute.

From nip roll (11), the tow of surface-treated filamentary polycaprolactam strands, which is now advantageously at a temperature of between about 40° and 45° C., crosses to drawstands (12) and (13), which provide a single-stage drawing operation. A multi-stage drawing action may be provided if desired; however, such is not essential. The individual drawstands are operated at surface speeds which will provide an overall draw ratio, as calculated from nip roll (11), of about 3 to about 5, most advantageously between 3.2 and 4.4. For example, drawstand (12) and drawstand (13) can be operated at surface speeds of 100 and 340 meters/minute, respectively. Moreover, when polymer which is free of delustrants such as titanium dioxide is employed, a stream of water is advantageously directed upon the tow at the first roll of drawstand (12), in order to prevent licking of the individual filaments on the polished drawrolls.

Tow from drawstand (13) is directed into essentially conventional crimping means (14), which is most advantageously a standard stuffer box, the diemensions of which have been shortened and widened to avoid excessive crimping and reduction of physical properties of the fiber. That is to say, the otherwise conventional stuffer box is modified to crimp fiber without "conventional" finish, and therefore with higher frictional characteristics. (The unwashed filamentary polymeric strands, which have a lower than usual modulus, have not been lubricated in the conventional manner). As is understood by those of skill in the art, crimping may also be accomplished employing other standard means such as air jet, edge, or gear techniques, or the like. In any event, a storage means such as conveyor (15) is employed to collect the crimped tow and feed it to conventional cutting means (16). The storage means allows an inventory of fiber to be built up in order to prevent shutdown if difficulties in the start-up of the cutter are encountered. Examples of conventional cutters advantageously employed are a Lummus or a Neumag Cutter, operating at a speed of about 250 meters/minute. (The cutter speed is of course varied to control crimped tow inventory in the storage means, after string-up and during normal operating conditions.) Cut fiber of nominal 4, 6, 7½ or 8 inch staple length is directed, as by gravity, to a standard multi-stage washer (17), wherein extractables are removed from the polymeric material. Very beneficial results are obtained when washer (17) is a multi-stage counterflow unit providing a residence time of about 20 seconds in each stage. Essentially monomer-free medium, e.g. water, enters the last stage of the washer and progresses up the washer to the fiber feed end by means of fluid sprays and weir-controlled tubs, as is well-known in the art. Highly desirable results are achieved if the first washing stage is a hot wash, and if dewatering is accomplished after each stage, as by means of squeeze rolls, the last of which is a vacuum roll for removal of surplus water from the fiber. Best results are achieved when 6–20 stages are employed. When 20 stages are utilized, it is possible to attain about 20 percent extractable material in the washwater and less than one percent of extractables in the polymer. It is convenient in this regard to control the loading of staple on the belt of the washer at about ¾ pound per square foot of active washer belt space. Spent wash medium is preferably treated by conventional means (not shown) for recovery of monomeric material, in order to further enhance the economy of operation of the instant process.

It is significant to observe that as a result of the draw-crimp-cut-wash sequence detailed herein, a fiber is produced having very low shrinkage characteristics and a very low extractable content. This combination of properties is not obtainable from any known process affording the economy of operation presented by the instant invention.

At the conclusion of the multiple stage washing procedure, the fiber is dried by conventional means. Alternatively, fiber from the last stage of the multi-stage countercurrent washer specified above is blown into the horizontal basket of standard continuous centrifuge (18), wherein a hydraulically activated rotating pusher plate reciprocates and strokes the fiber cake continually forward in the basket. Centrifugal force is typically 950 g and residence time is typically 2 minutes. Fiber leaving the basket is pulled into a blower (19), whence it is blown into standard belt dryer (20). At this point the fiber contains 10–15% by weight of water; approximately 1 pound of water per pound of dry fiber has been removed by the centrifuge. Conventional dryers typically operate at about 100°–150° C. with a residence time of about 6 minutes. Under such conditions the staple can be dried to a moisture level of about 1–1½ percent, at a dryer loading of about ¾ pound of fiber per square foot of dryer belt. Fiber exiting the dryer (20) is lifted from the belt thereof by a low pressure air jet or similar means and slides down a chute (21) into hopper (22), which feeds baler (23).

Produced by the process detailed above is a staple fiber product having: (1) no surface coating of monomeric and oligomeric materials, as a result of the efficient removal of extractables; (2) a very low, uniform shrinkage; and (3) a very high crimp stability. This product is eminently suitable for use in the production of spun yarns for use in the fabrication of carpets.

Although the process of the present invention has been described in detail with respect to certain preferred embodiments thereof, it is understood by those of skill in the art that variations and modifications in this detail may be effected without any departure from the spirit and scope of the present invention, which is defined in the hereto-appended claims.

We claim:

1. A continuous process for the production of a staple fiber product, which process comprises:

A. Spinning an equilibrium melt from a standard hydrolytic or anionic polymerization of caprolactam, the equilibrium melt containing methanol-extractable material including monomeric and oligomeric substances, the equilibrium melt being spun at a temperature of between about 230° and 270° C. through a spinnerette, the spinning take-away speed being less than about 250 meters/minute; the spinnerette having a multiplicity of holes spaced from each other in an asymmetric arrangement wherein the space between adjacent holes increases from each side of the spinnerette to the center thereof and from the front to the back thereof, the front being defined as that section proximate to the first entrance of quench gas, as set forth below, and the back being defined as that section proximate to the exhaust of quench gas, as set forth below;

B. Quenching the molten polycaprolactam in two phases: (1) Directing gas at a temperature of less than 20° C. at a flow rate of between 200 and 500 cubic feet/minute for a polycaprolactam throughput of between about 0.25 to 1 gram/minute/spinnerette hole, to impinge upon the face of the spinnerette and molten polycaprolactam stands immediately adjacent thereto from a first entrance which is proximate to the section of the spinnerette referred to as the front thereof, and to be exhausted proximate to the section of the spinnerette referred to as the back thereof; and (2) Directing gas at a temperature of less than about 20° C. in an essentially countercurrent flow from a second entrance downstream from the first entrance with respect to the direction of movement of the filamentary polycaprolactam, at a rate which results in reducing the surface temperature of the polycaprolactam to a value between about 30° and 70° C. before drawing thereof as hereinafter defined;

C. Applying a drawing and crimping lubricant and antistatic agent to the surface of the filamentary polycaprolactam;

D. Drawing the filamentary polycaprolactam by conventional means at a total draw ratio between about 3 and 5;

E. Crimping the drawn filamentary polycaprolactam by essentially conventional means;

F. Cutting the crimped filamentary polycaprolactam into staple lengths by conventional means;

G. Subjecting the filamentary polycaprolactam staple to a multiple stage washing procedure for removal of extractables;

H. Drying the washed filamentary polycaprolactam staple by conventional means; and I. Packaging the dried filamentary polycaprolactam staple for subsequent use or sale.

2. The process of claim 1, wherein the drawing and crimping lubricant and antistatic agent is a compound or mixture which does not adversely affect conventional, wet monomer recovery systems.

3. The process of claim 2, wherein the drawing and crimping lubricant and antistatic agent is water, which is applied in an amount of about 25–50 pounds thereof per every 100 pounds of dry filamentary polycaprolactam.

4. The process of claim 3, wherein crimping is effected in an otherwise standard stuffer box, the dimensions of which have been shortened and widened to avoid excessive crimping and reduction of physical properties of the fiber.

5. The process of claim 1, wherein the exhausted quenching gas from step B, which comprises unreacted monomeric material, is treated by conventional recovery techniques, such as a wet scrubber or electrostatic precipitator, to recover the monomeric material.

6. The process of claim 1, wherein the draw ratio is between 3.2 and 4.4.

7. The process of claim 1, wherein the spent wash medium from step G is treated by conventional means for recovery of the monomer.

* * * * *